US006298581B1

(12) United States Patent
Chern

(10) Patent No.: US 6,298,581 B1
(45) Date of Patent: Oct. 9, 2001

(54) ELASTIC SHOE PAD

(76) Inventor: Ming-Dong Chern, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/677,797

(22) Filed: Sep. 28, 2000

(51) Int. Cl.[7] ..... A43B 13/20
(52) U.S. Cl. ..... 36/29; 36/28; 36/35 B
(58) Field of Search ..... 36/28, 29, 35 R, 36/37, 35 B, 71

(56) References Cited

U.S. PATENT DOCUMENTS 5,005,300 * 4/1991 Diaz et al. ..... 36/28
5,118,555 * 6/1992 Horovitz ..... 36/28
5,212,878 * 5/1993 Burke et al. ..... 36/28
5,220,737 * 6/1993 Edington ..... 36/28
5,679,327 * 10/1997 Halberstadt ..... 36/28
6,209,226 * 4/2001 Squadroni ..... 36/29

* cited by examiner

*Primary Examiner*—M. D. Patterson

(57) ABSTRACT

An elastic shoe pad has an elastic seat and a positioning seat engaging with the elastic seat. The elastic seat has an elastic plate, a plurality of connecting bars disposed on a bottom of the elastic plate, and a plurality of elastic tubes connected to the connecting bars. The positioning seat has a plurality of hollow chambers matching the elastic tubes, and a plurality of upper slots communicating with the hollow chambers. The elastic tubes are inserted in the hollow chambers. An outsole has an upper periphery flange. The elastic shoe pad is disposed on the outsole. The upper periphery flange encloses the elastic shoe pad.

1 Claim, 6 Drawing Sheets

ELASTIC SHOE PAD

BACKGROUND OF THE INVENTION

The present invention relates to an elastic shoe pad. More particularly, the present invention relates to an elastic shoe pad which has an elastic seat and a positioning seat protecting the elastic seat.

Most conventional elastic shoe pads have elastic fatigure problems after a long period of usage. Some elastic shoe pads have air or silicones therein. However, the elastic shoe pads become useless if the elastic shoe pads are pierced.

SUMMARY OF THE INVENTION

An object of the present invention is to provide an elastic shoe pad which has an elastic seat and a positioning seat protecting the elastic seat.

Another object of the present invention is to provide an elastic shoe pad which has an elastic seat and a positioning seat reducing an elastic fatigure of the elastic seat after a long period of usage.

Accordingly, an elastic shoe pad comprises an elastic seat and a positioning seat engaging with the elastic seat. The elastic seat has an elastic plate, a plurality of connecting bars disposed on a bottom of the elastic plate, and a plurality of elastic tubes connected to the connecting bars. The positioning seat has a plurality of hollow chambers matching the elastic tubes, and a plurality of upper slots communicating with the hollow chambers. The elastic tubes are inserted in the hollow chambers. An outsole has an upper periphery flange. The elastic shoe pad is disposed on the outsole. The upper periphery flange encloses the elastic shoe pad. The upper periphery flange and the elastic shoe pad are sealed together by a high frequency method.

DETAILED DESCRIPTION OF THE INVENTION

Figure 1:
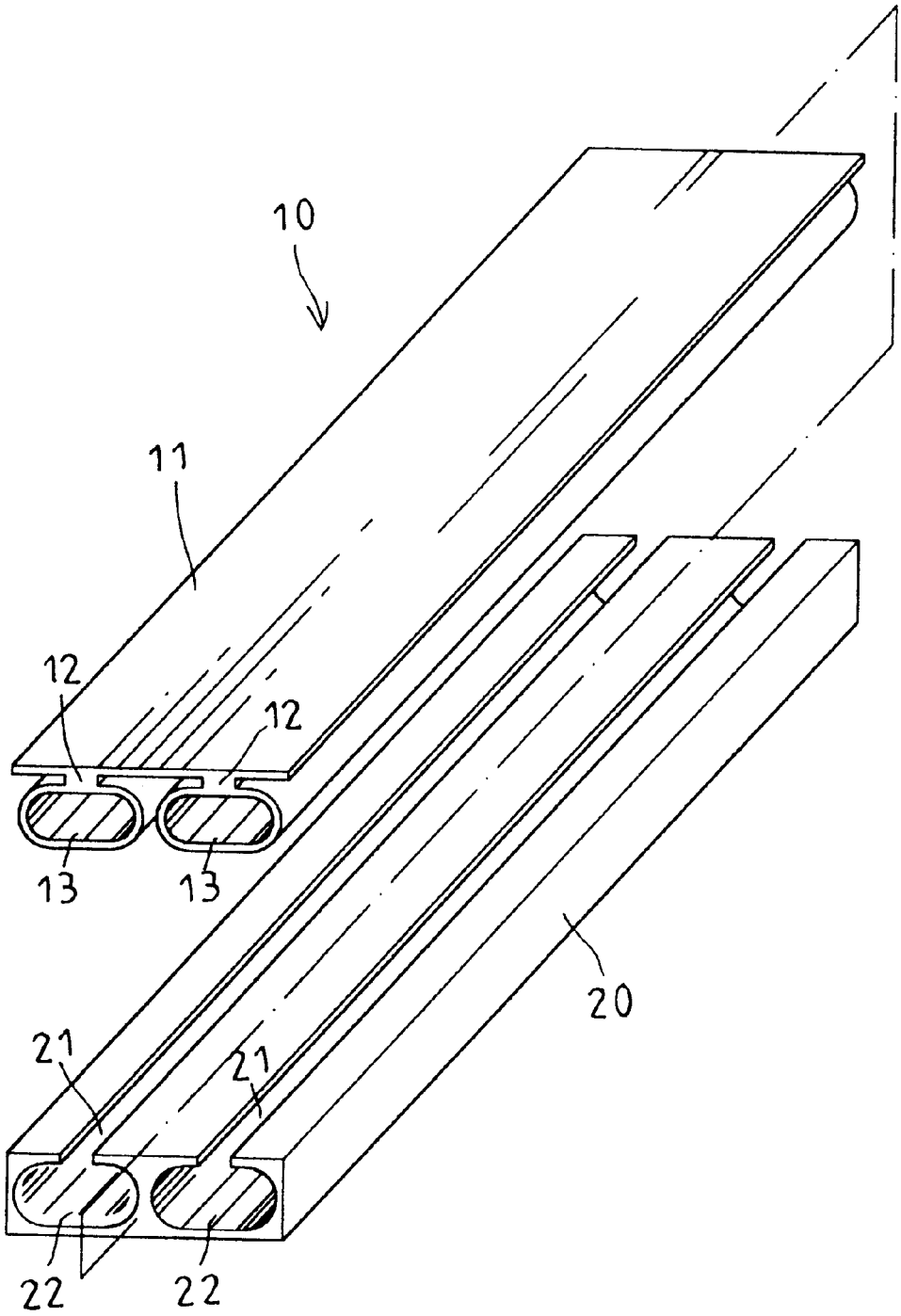
FIG. 1 is a perspective exploded view of an elastic shoe pad of a preferred embodiment in accordance with the present invention.
Figure 2:
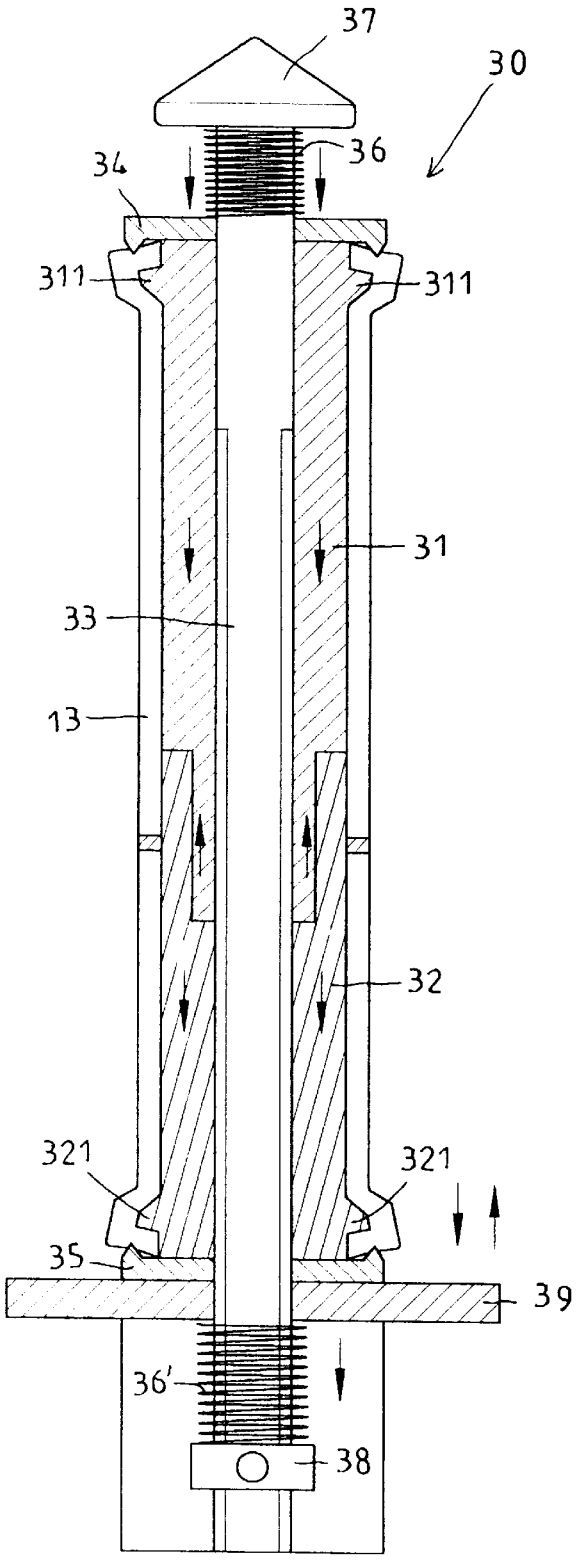
FIG. 2 is a sectional assembly view of a stretcher.
Figure 3:
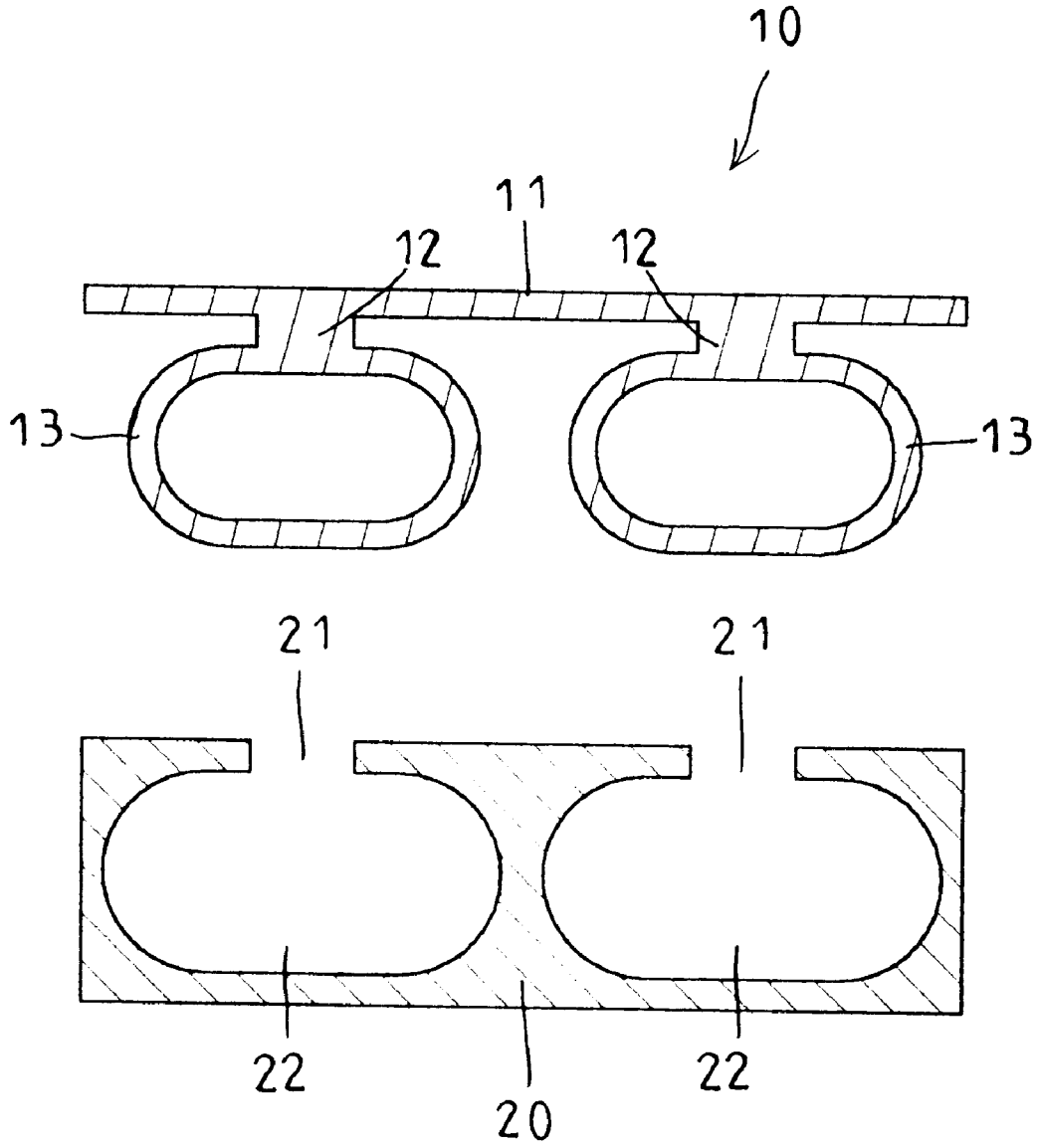
FIG. 3 is a sectional exploded view of an elastic shoe pad of a preferred embodiment in accordance with the present invention.
Figure 4:
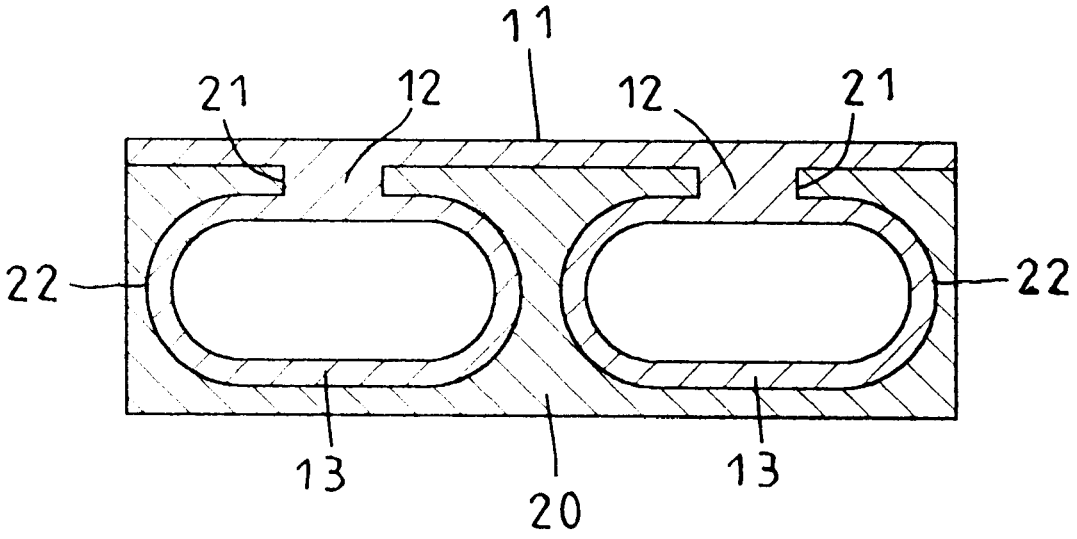
FIG. 4 is a sectional assembly view of an elastic shoe pad of a preferred embodiment in accordance with the present invention.
Figure 5:
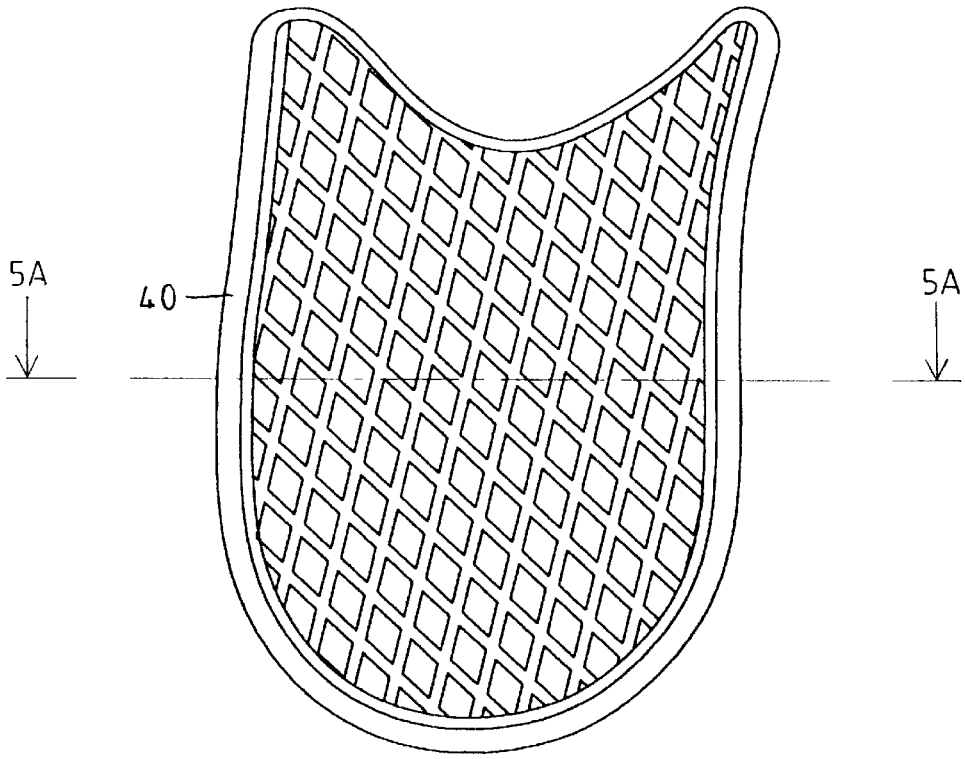
FIG. 5 is an elevational view of an outsole and an elastic shoe pad of a preferred embodiment in accordance with the present invention.
Figure 5A:
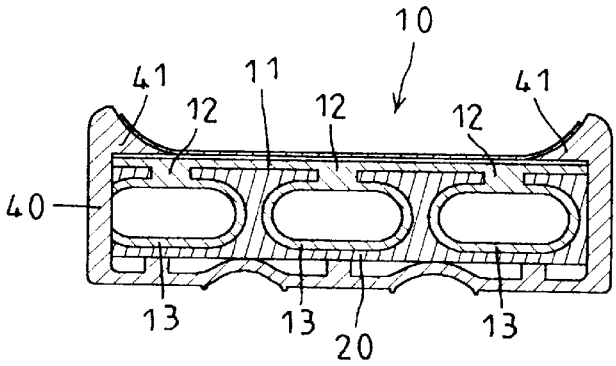
FIG. 5A is a sectional view taken along line 5A—5A in FIG. 5.

Referring to FIGS. 1 to 5A, an elastic shoe pad comprises an elastic seat 10 and a positioning seat 20 engaging with the elastic seat 10.

The elastic seat 10 has an elastic plate 11, a plurality of connecting bars 12 disposed on a bottom of the elastic plate 11, and a plurality of elastic tubes 13 connected to the connecting bars 12.

The positioning seat 20 has a plurality of hollow chambers 22 matching the elastic tubes 13, and a plurality of upper slots 21 communicating with the hollow chambers 22.

The elastic tubes 13 are inserted in the hollow chambers 22.

An outsole 40 has an upper periphery flange 41.

The elastic shoe pad is disposed on the outsole 40.

The upper periphery flange 41 encloses the elastic shoe pad. The upper periphery flange 41 and the elastic shoe pad are sealed together by a high frequency method.

Referring to FIG. 2 again, a stretcher 30 is inserted in one of the elastic tubes 13. The elastic tube 13 is deformed and stretched in order to place the elastic tube 13 into the respective hollow chamber 22. After the elastic tube 13 is inserted in the respective hollow chamber 22, the stretcher 30 is removed.

The stretcher 30 has a male sleeve 31 inserted in the elastic tube 13, a female sleeve 32 inserted in the elastic tube 13, the male sleeve 31 engaging with the female sleeve 32, the male sleeve 31 having a first flange 311, the female sleeve 32 having a second flange 321, a first plug 34 and the first flange 311 clamping an end of the elastic tube 13, a second plug 35 and the second flange 321 clamping another end of the elastic tube 13, a collar 39 disposed on the second plug 35, a shaft 33 passing through a first compression spring 36, the first plug 34, the male sleeve 31, the female sleeve 32, the second plug 35, a second compression spring 36', and the collar 39.

A positioning block 37 is disposed on an end of the shaft 33. A movable block 38 is disposed on another end of the shaft 33.

Figure 6:
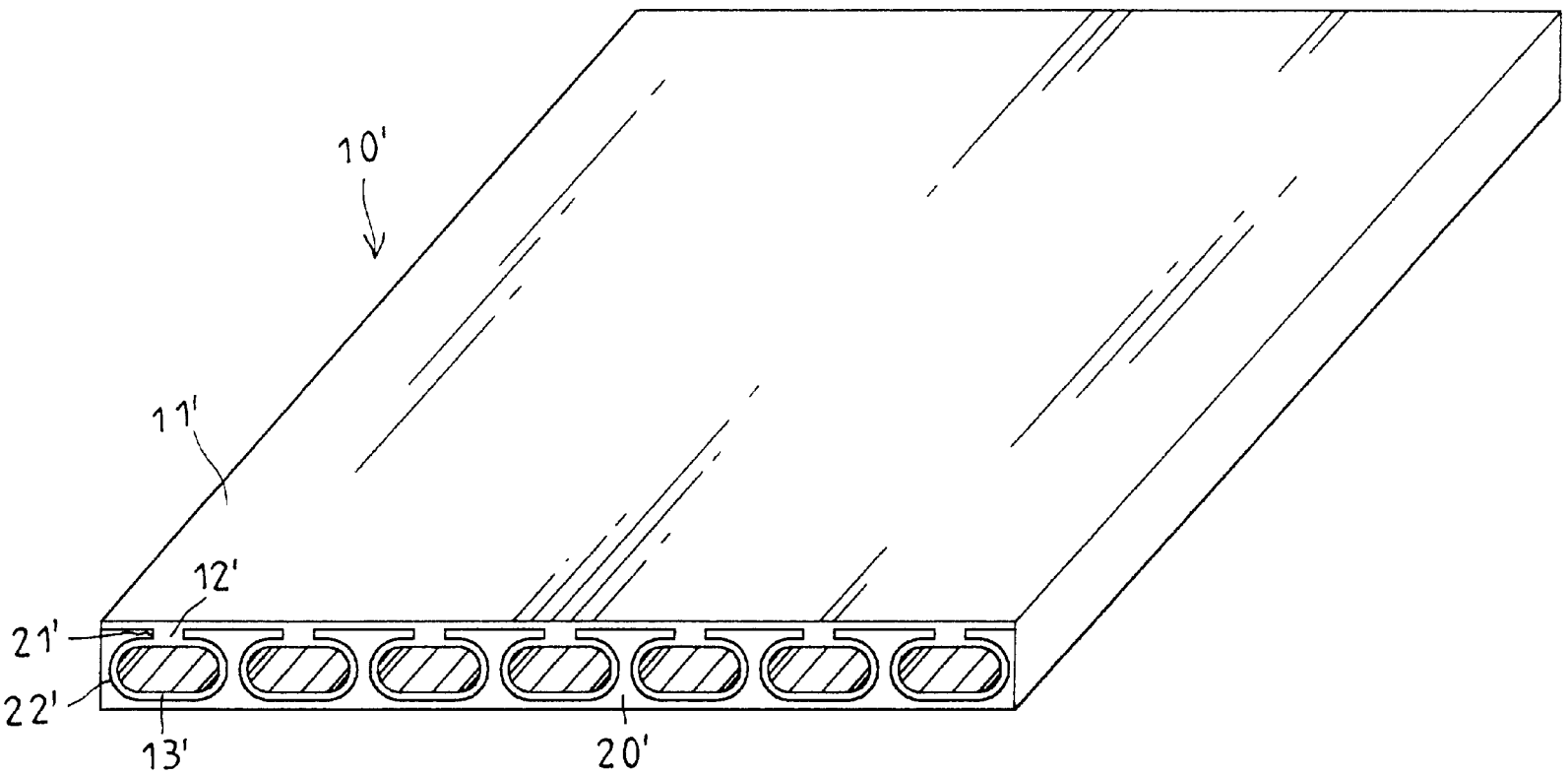
FIG. 6 is a perspective assembly view of an elastic shoe pad of another preferred embodiment in accordance with the present invention.

Referring to FIG. 6, another elastic shoe pad comprises an elastic seat 10' and a positioning seat 20' engaging with the elastic seat 10'.

The elastic seat 10' has an elastic plate 11', seven connecting bars 12' disposed on a bottom of the elastic plate 11', and seven elastic tubes 13' connected to the connecting bars 12'.

The positioning seat 20' has seven hollow chambers 22' matching the elastic tubes 13', and seven upper slots 21' communicating with the hollow chambers 22'.

The elastic tubes 13' are inserted in the hollow chambers 22'.

The present invention is not limited to the above embodiment but various modification thereof may be made. Furthermore, various changes in form and detail may be made without departing from the scope of the present invention.

I claim:

1. An elastic shoe pad comprises:

an elastic seat and a positioning seat engaging with the elastic seat, the elastic seat having an elastic plate, a plurality of connecting bars disposed on a bottom of the elastic plate, and a plurality of elastic tubes connected to the connecting bars, the positioning seat having a plurality of hollow chambers matching the elastic tubes, and a plurality of upper slots communicating with the hollow chambers, the elastic tubes inserted in the hollow chambers, an outsole having an upper periphery flange, the elastic shoe pad disposed on the outsole, the upper periphery flange enclosing the elastic shoe pad, wherein the upper periphery flange and the elastic shoe pad are sealed together by a high frequency method.

* * * * *